US010448461B2

(12) United States Patent
Franco Gutierrez et al.

(10) Patent No.: US 10,448,461 B2
(45) Date of Patent: Oct. 15, 2019

(54) COOKTOP HAVING A PLURALITY OF HEATING ELEMENTS

(71) Applicant: BSH Hausgeräte GmbH, Munich (DE)

(72) Inventors: Carlos Franco Gutierrez, Saragossa (ES); Teresa Del Carmen Marzo Alvarez, Saragossa (ES); David Paesa García, Saragossa (ES); Beatriz Villanueva Valero, Teruel (ES)

(73) Assignee: BSH Hausgeräte GmbH, Munich (DE)

( * ) Notice: Subject to any disclaimer, the term of this patent is extended or adjusted under 35 U.S.C. 154(b) by 113 days.

(21) Appl. No.: 15/118,900

(22) PCT Filed: Feb. 5, 2015

(86) PCT No.: PCT/IB2015/050875
§ 371 (c)(1),
(2) Date: Aug. 15, 2016

(87) PCT Pub. No.: WO2015/128759
PCT Pub. Date: Sep. 3, 2015

(65) Prior Publication Data

US 2017/0055318 A1 Feb. 23, 2017

(30) Foreign Application Priority Data

Feb. 28, 2014 (ES) ..... 201430282

(51) Int. Cl.
*H05B 3/68* (2006.01)
*H05B 1/02* (2006.01)
(Continued)

(52) U.S. Cl.
CPC ..... *H05B 6/062* (2013.01); *F24C 7/062* (2013.01); *H05B 2213/03* (2013.01); *H05B 2213/05* (2013.01); *H05B 2213/07* (2013.01)

(58) Field of Classification Search
CPC . F24C 7/06; F24C 7/062; F24C 7/067; H05B 2213/03; H05B 2213/05; H05B 2213/07; H05B 6/062
(Continued)

(56) References Cited

U.S. PATENT DOCUMENTS

2007/0164017 A1 7/2007 Gouardo et al.
2012/0024840 A1* 2/2012 Lee ..... H05B 6/062 219/622

FOREIGN PATENT DOCUMENTS

DE 10033361 A1 1/2002
EP 2166290 A1 3/2010
(Continued)

OTHER PUBLICATIONS

English machine translation of EP 2211591, Jul. 2010.*
(Continued)

*Primary Examiner* — Sang Y Paik
(74) *Attorney, Agent, or Firm* — Michael E. Tschupp; Andre Pallapies; Brandon G. Braun

(57) ABSTRACT

In a method for operating a cooktop, a process of removal and placement of a cookware element with respect to a starting position and an end position is detectable by a detection arrangement. A control unit forms a heating zone to match a detected cookware element. The process can be independently associated by the control unit in one of two ways, a first way in which the process involves a movement of cookware element from the starting position into the end position and a movement of the heating zone into an area of the end position, with a target temperature, set by a user interface, being carried over to the area of the end position, a second way in which the process involves removal of cookware element from the starting position and placement
(Continued)

of another cookware element in the end position, with a target temperature set to a default value.

16 Claims, 2 Drawing Sheets

(51) Int. Cl.
*H05B 6/06* (2006.01)
*F24C 7/06* (2006.01)
(58) Field of Classification Search
USPC ..... 219/443.1–468.2, 518
See application file for complete search history.

(56) References Cited

FOREIGN PATENT DOCUMENTS

| | | | |
|---|---|---|---|
| EP | 2211591 | A1 | 7/2010 |
| WO | 9737515 | A1 | 10/1997 |
| WO | 2009049989 | A1 | 4/2009 |

OTHER PUBLICATIONS

International Search Report PCT/IB2015/050875 dated Mar. 18, 2015.
National Search Report ES 201430282 dated Feb. 28, 2014.

* cited by examiner

COOKTOP HAVING A PLURALITY OF HEATING ELEMENTS

CROSS-REFERENCES TO RELATED APPLICATIONS

This application is the U.S. National Stage of International Application No. PCT/IB2015/050875, filed Feb. 5, 2015, which designated the United States and has been published as International Publication No. WO 2015/128759 and which claims the priority of Spanish Patent Application, Serial No. P201430282, filed Feb. 28, 2014, pursuant to 35 U.S.C. 119(a)-(d).

BACKGROUND OF THE INVENTION

The invention relates to a method for operating a cooktop and to a cooktop having a plurality of heating elements.

What are known as matrix cooktops having a plurality of small heating elements of the same construction and arranged in a grid are known from the prior art. One of the characterizing features of such cooktops is the possibility to form a flexible heating zone adapted to the size, shape and position of a cookware element placed on the cooktop from one or more of such heating elements. The user can, to a large extent, therefore position the cookware element freely and the association of different heating elements, in particular of inductors of an induction hob, with the cookware element takes place automatically such that the heating elements which can most effectively heat the cookware element are associated with this cookware element or with a heating zone adapted to this cookware element.

BRIEF SUMMARY OF THE INVENTION

The object underlying the invention is to provide a working method for operating a cooktop having freely definable heating zones, which has improved operating convenience.

The invention is based in particular on a method for operating a cooktop having a plurality of heating elements. The method comprises the detection of a cookware element by means of a detection arrangement, the formation of a heating zone adapted to the detected cookware element from one heating element or multiple heating elements and the setting of at least one target temperature of the heating zone by means of a user interface.

It is proposed in particular that a process, which comprises the removal of the cookware element from a starting position and the subsequent placing of the cookware element in an end position is detected by the detection arrangement. It is significant here that with the aid of the detection arrangement the control unit identifies the process as a whole and as a unit and does not interpret the process of removing the cookware element and the process of placing the cookware element as two separate processes. The method therefore further comprises the assignment of the process to one of at least two cases by the control unit. Here the process is interpreted in a first case as a movement of the same cookware element from the starting position into the end position. In further cases, the control unit independently recognizes that the same cookware element is not displaced, but rather one cookware element is removed and a new cookware element is placed. At least in the first case of displacing the same cookware element, the control unit moves the heating zone out of the area of the starting position into the area of the end position. To this end, new heating elements are assigned to the heating zones and at least one part of the original heating elements assigned to the heating zones is removed or deactivated. At least in the first case, which relates to a displacement of the same cookware element, the originally set target temperature is carried over for the moved heating zone by the control unit. In the further case, the target temperature is set to a default value by the control unit. The default value is in particular zero. The cooktop is operated here with a temperature regulation. A target temperature can be set indirectly by the user, for instance by selecting a cooking program, or directly, for instance by directly setting the desired cooking temperature. The actual temperature determined with the aid of temperature sensors is used by the cooktop as control parameters. The inventive method permits a resetting of the target temperature to be dispensed with after displacing the cookware, as a result of which operator convenience is significantly improved.

Aside from the target temperature carried over in accordance with the invention, further operating parameters of the heating zone can be carried over, for instance timer settings, such as a remaining time. If more complex cooking programs run on the heating zone, cooking programs which were interrupted by the displacement of the cookware element can be continued on the moved heating zone.

Advantageously the control unit determines a further operating parameter of the process and in the first case associates the process with one of at least two sub cases as a function of the further operating parameter: In a first sub case, the at least one set target temperature, together with at least one associated control parameter, is carried over for the moved heating zone. In a second sub case, the at least one set target temperature is carried over for the moved heating zone and at least one associated control parameter is redetermined as a function of the further operating parameter. The further operating parameter is, for instance, a cooking program, a temperature range and/or a sensor type. A recalibration of the temperature control is required as a function of the sensor type available for the moved heating zone, for instance cooking temperature or roasting temperature sensor. This situation is allowed by the further development.

In a further development of the invention, it is proposed that the association of the process with one of the cases takes place on the basis of at least one parameter, which can be set by a user by way of the user interface. The control unit can, in particular, determine a characteristic for the process, compare this characteristic with the parameter and perform the assignment or case distinction as a function of the result of this comparison.

The control unit can determine suitable parameters, if it determines a spatial distance between the starting position and the end position of the process for instance. This distance can be used in the assignment of the process to the different cases. Displacements by comparably small distances are frequently unintentional, so that the carrying-over of the operating parameters of the heating zone corresponds to the wishes of the user.

Furthermore, the control unit can also determine a time interval between the removal of the cookware element from the starting position and the placing of the cookware element in the end position and perform the assignment of the process as a function of the time interval. A large time interval indicates that the user wishes to interrupt the original cooking process and to start a new cooking process, while the displacement or repositioning of the cookware element in a brief time interval generally reflects the wishes of the user not to interrupt the cooking process as far as possible. The time in which the repositioned or displaced cookware element remains unheated can be shortened by the automatic carrying-over of the operating parameters.

The case of displacing the same cookware element can then, in particular, be easily distinguished from the placing of another cookware element by the control unit if the control unit compares a size and/or shape of the cookware element removed from the starting position with a size and/or shape of the cookware element placed on the end position. If the differences in size and shape lie within a measuring accuracy of the detection arrangement, this probably involves the same cookware element, whereas if on the other hand it involves another cookware element the carrying-over of the operating parameters for the new cookware element is probably not desired.

A further feature which can be used to identify the cookware element involves the material properties of the cookware element. These can be measured by the detection arrangement and used by the control unit to identify the cookware element.

According to a particularly advantageous embodiment of the invention, it is proposed that in at least one case by inputting into the user interface the user can select whether the set operating parameter or the set operating parameters is/are or is/are not to be carried over for the moved heating zone. In cases of doubt, a misinterpretation of the process, which may displease the user, can be avoided by intervention from the user.

In addition to the afore-cited parameters which permit the assignment of the process to the different cases, the control unit can detect a speed of a movement of the cookware element from the starting position into the end position and can determine the temperature of the cookware element. Both characteristics can be used to classify the process and/or to identify the cookware element.

A further aspect relates to a cooktop with a control unit, which performs the inventive method. The cooktop comprises a plurality of heating elements, a detection arrangement, a control unit and a user interface.

BRIEF DESCRIPTION OF THE DRAWINGS

Further advantages result from the description of the drawings below. Exemplary embodiments of the invention are shown in the drawing. The drawing, the description and the claims contain a combination of numerous features. The person skilled in the art will also expediently consider the features individually and combine them to form further meaningful combinations, in which:

DETAILED DESCRIPTION OF EXEMPLARY EMBODIMENTS OF THE PRESENT INVENTION

Figure 1:
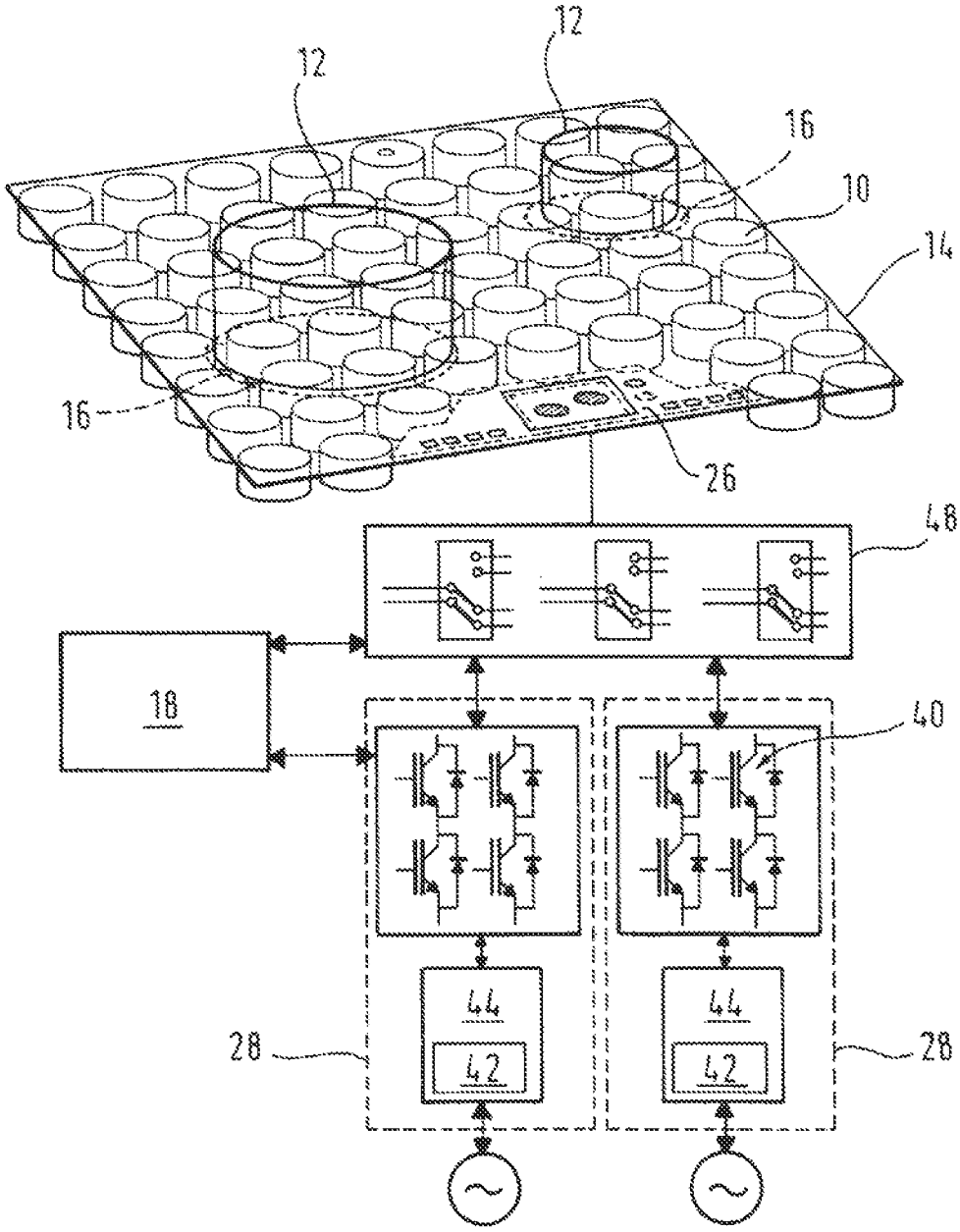
FIG. 1 shows a schematic representation of a cooktop apparatus having a plurality of heating elements, a control unit and a user interface.

FIG. 1 shows an induction cooktop having a plurality of heating elements embodied as inductors 10. The inductors 10 are arranged in a uniform grid, are of the same construction and can be operated by a control unit 18 substantially independently of one another. The control unit 18 is a universally programmable computing unit, which generates control signals to operate one or more power electronics modules 28. The power electronics modules 28 comprise a number of inverters 40, a filter 42 and a rectifier 44. A switching arrangement 48 connects the inverter 40 to different inductors 10.

The inverters 40 generate a high-frequency heating current, which flows through the inductors 10 and generates a high-frequency magnetic field. The magnetic field generates eddy currents in a base of a cookware element 12 placed on the cooktop, said eddy currents heating the cookware element 12. The heat output generated by the inductors 10 can be set by varying a frequency and/or amplitude of the heating current generated by the inverters 40.

The control unit 18 uses the inductors 10 as a detection arrangement 14 to detect the cookware elements 12 placed on the cooktop. To this end, the control unit 18 measures the influence of the cookware elements 12 on the inductance of the inductors 10 or of the overall system consisting of the inductors 10 and the base of the cookware element 12. Furthermore, the electrical losses in the base of the cookware element 12 result in a frequency-dependent resistance or loss angle in the inductors 10. These loss angles can be used in addition to detect the cookware element 12 or to measure material properties of its ferromagnetic base.

The control unit 18 can, as a function of these measured variables, in particular determine a degree of overlap between the base of the cookware element 12 and each of the inductors 10 and from these measured variables determine the position, size and shape of the base of the cookware element 12. As a function of this data, the control unit 18 forms a heating zone 16 for each cookware element 12, which is adapted in terms of its size, shape and position to the size, shape and position of the detected cookware element 12. The control unit 18 combines the inductors 10 which are covered by more than a predetermined portion by the base of the cookware element 12, together with the heating zone 16, which is assigned to the relevant cookware element 12.

At one front edge of the cooktop, this comprises a user interface 26, on which the control unit 18 visualizes the heating zones 16 adapted to the detected cookware elements 12. The user can set a target temperature and other operating parameters, for instance a timer runtime or a time for automatically switching off the heating zone 16 by way of the user interface 26 on each heating zone 16.

The cooktop determines an actual temperature for temperature regulation purposes. The actual temperature is formed by a detected cooking temperature, i.e. in particular by a cookware temperature. In order to detect the actual temperature, the cooktop has sensor units arranged below the cooktop plate with at least one temperature sensor. Alternatively or in addition, provision could also be made for a sensor unit arranged at least partially above the cooktop plate, which detects the actual temperature using infrared. An automatic temperature unit is provided to regulate the actual temperature to the target temperature. The automatic temperature unit can also be embodied as an automatic cooking program unit, which regulates different cooking programs with different, temporal changes in temperature.

Figure 2:
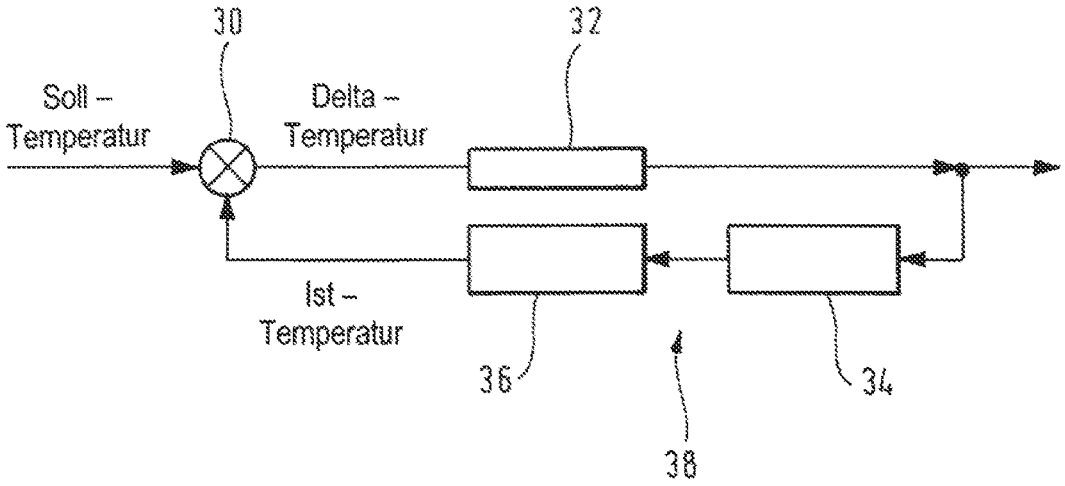
FIG. 2 shows a schematic representation of a process flow for a temperature regulation.

FIG. 2 shows a schematic representation of a process flow for a temperature regulation. The user sets a desired target temperature by way of a user interface. The set target temperature is compared with the actual temperature by way of a differentiator 30. A Delta temperature=target temperature−actual temperature is determined in this way. A control unit 32 determines the required heat output in order to reach the Delta temperature, and controls the heating zone accordingly. In a return loop 38, a cookware temperature is determined by means of a temperature sensor 34. Since the temperature sensor in this exemplary embodiment cannot determine the food temperature, a food temperature is determined by way of a temperature estimation unit 36. This food temperature is the actual temperature and is fed to the differentiator 30. In a predetermined cycle time, this control loop is repeated until the heating of the heating zone is ended.

For as precise a temperature regulation as possible, the parameters of the control unit 32 and the temperature estimation unit 36 should be calibrated as a function of a selected cooking program and of the sensor type used. For instance, a boil sensor is designed for a lower temperature range below 120° Celsius than a cooking sensor, which is designed for a temperature range significantly above 120° Celsius. A cooking program for steaming vegetables also differs significantly from a cooking program for deep-fat frying potatoes. In the first case, a gentle and uniform heating occurs in a lower temperature range, whereas the second case requires the rapid heating-up and retaining of a high temperature range.

Figure 3:
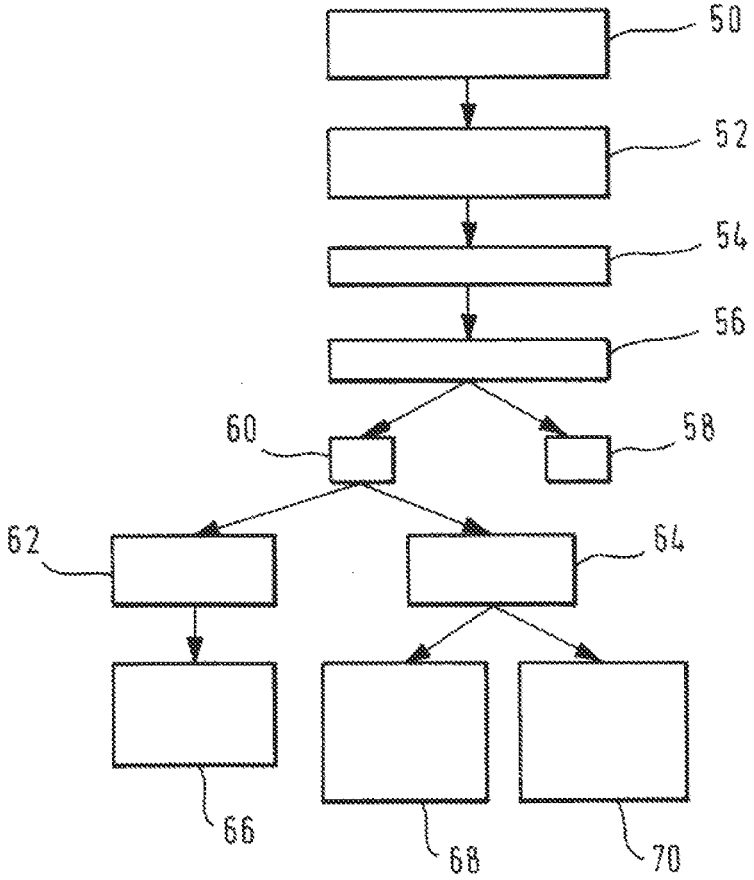
FIG. 3 shows a schematic representation of an inventive process flow.

FIG. 3 shows a schematic representation of an inventive process flow. In the first step 50, the temperature regulation of a heating zone of a cooktop is started, once the user has input a desired target temperature. The control unit and the temperature estimation unit from FIG. 2 are firstly calibrated 52. In this exemplary embodiment, for calibration purposes the heating zone is briefly applied with a predetermined power and the temperature is thus measured. From the ratio between this applied power and the measured temperature, parameters are determined for the calibration. After ending the calibration, the heating zone, as described in FIG. 2, is heated 54.

In the next step 56, a movement of the cookware is defined. To this end the detection arrangement detects the position, size and shape of the cookware element in regular cycles, in particular with cycle times of less than one second. The measured data is stored so that a change in the position can be immediately recognized by comparing the earlier measured data with the current measured data.

If a change in the measured data of the detection arrangement is identified, which is greater than a threshold value determined by the measurement accuracy of the detection arrangement, a timer or a time detection algorithm of the control unit begins to run. If the placing of the cookware element in the end position is detected within a predetermined time of approx. 10 seconds, the method is continued with step 60. Otherwise, the cooking process is ended 58.

In step 60, further operating parameters, for instance the selected cooking program, are determined by the control unit. If the selected cooking program is provided 62 for a temperature range of below 110° Celsius and if the temperature sensors installed in a regular grid between the inductors are thus used for measurement purposes, the control parameters remain unchanged and can be carried over 66 unchanged for the temperature regulation of the new heating zone. If the selected cooking program is provided 64 for a temperature range of above 120° Celsius and if irregularly installed frying temperature sensors are thus used for the measurement, the control parameters are at least partially recalibrated 68 for the new heating zone. In this exemplary embodiment, the recalibration of the control parameters takes place as a function of the relative position between the frying temperature sensors and the cookware. The remaining control parameters remain unchanged 70.

The invention claimed is:

1. A method for operating a cooktop having a plurality of heating elements, comprising the steps:

detecting by a detection arrangement a process of removal and placement of a cookware element with respect to a starting position and an end position;

when detecting placement of the cookware element, forming via a control unit a heating zone from one or more heating elements to match the cookware element;

setting at least one target temperature of the heating zone via a user interface;

independently associating the process by the control unit in one of two ways, a first way in which the process involves a movement of the cookware element from the starting position into the end position and a movement of the heating zone into an area of the end position, with the at least one set target temperature being carried over to the area of the end position, a second way in which the process involves a removal of the cookware element from the starting position and placement of another cookware element in the end position, with the target temperature being set to a default value by the control unit; and determining by the control unit a further operating parameter of the process, and associating the process in the first way to one of at least two sub cases as a function of the further operating parameter, a first sub case in which the at least one set target temperature together with at least one associated control parameter is carried over for the moved heating zone if the further operating parameter is determined to be a first cooking program having a first temperature range of below a first predetermined temperature, and a second sub case in which the at least one set target temperature is carried over for the moved heating zone and at least one associated control parameter is redetermined as a function of the further operating parameter if the further operating parameter is determined to be a second cooking program having a second temperature range of above a second predetermined temperature, wherein, in the second sub case, the determining by the control unit of the further operating parameter of the process includes a determination of a type of sensor used in the second cooking program, and the at least one associated control parameter is redetermined as a function of the type of sensor used in the second cooking program.

2. The method of claim 1, wherein the first predetermined temperature is one of 110° C. and 120° C.

3. The method of claim 2, wherein the second predetermined temperature is 120° C.

4. The method of claim 1, wherein the process is associated to one of the two ways on the basis of at least one parameter to be set by a user.

5. The method of claim 1, wherein the control unit determines a spatial distance between the starting position and the end position of the process, with the process being associated as a function of the spatial distance.

6. The method of claim 1, wherein the control unit determines a temporal distance between the removal of the cookware element from the starting position and the placement of the cookware element in the end position, with the process being associated as a function of the temporal distance.

7. The method of claim 1, wherein the control unit compares a size of the cookware element removed from the starting position and a size of the cookware element placed on the end position, with the process being associated as a function of a result of the comparison.

8. The method of claim 1, further comprising measuring material properties of the cookware element by the detection arrangement, and identifying the cookware element as a function of the material properties of the cookware element.

9. The method of claim 1, wherein a user through input into the user interface selects whether the at least one set target temperature is carried over for the moved heating zone.

10. The method of claim 1, wherein the control unit detects a speed of the movement of the cookware element from the starting position into the end position and associates the process as a function of the speed.

11. The method of claim 1, further comprising measuring a temperature of the cookware element via the detection arrangement, and identifying the cookware element as a function of the temperature of the cookware element.

12. The method of claim 1, wherein the type of sensor is one of a boil sensor, a cooking sensor, a roasting sensor, and a frying sensor.

13. The method of claim 1, wherein the at least one associated control parameter is redetermined as a function of a distance between the sensor and the cookware element.

14. A cooktop, comprising:

a plurality of heating elements;

a detection arrangement for detecting a cookware element;

a control unit configured to form a heating zone from one or more heating elements to match the detected cookware element, and a user interface for setting at least one target temperature of the heating zone, the detection arrangement and the control unit being configured to detect a process of removal and placement of a cookware element with respect to a starting position and an end position, said control unit independently associating the process in one of two ways, a first way in which the process involves a movement of the cookware element from the starting position into the end position and a movement of the heating zone into an area of the end position, with the at least one set target temperature being carried over to the area of the end position, a second way in which the process involves a removal of the cookware element from the starting position and placement of another cookware element in the end position, wherein control unit is configured to determine a further operating parameter of the process, and associating the process in the first way to one of at least two sub cases as a function of the further operating parameter, a first sub case in which the at least one set target temperature together with at least one associated control parameter is carried over for the moved heating zone if the further operating parameter is determined to be a first cooking program having a first temperature range of below a first predetermined temperature, and a second sub case in which the at least one set target temperature is carried over for the moved heating zone and at least one associated control parameter is redetermined as a function of the further operating parameter if the further operating parameter is determined to be a second cooking program having a second temperature range of above a second predetermined temperature, wherein, in the second sub case, the determining by the control unit of the further operating parameter of the process includes a determination of a type of sensor used in the second cooking program, and the at least one associated control parameter is redetermined as a function of the type of sensor used in the second cooking program.

15. The cooktop of claim 14, wherein the first predetermined temperature is one of 110° C. and 120° C.

16. The cooktop of claim 15, wherein the second predetermined temperature is 120° C.

* * * * *